United States Patent [19]

Coller

[11] Patent Number: 4,589,464

[45] Date of Patent: May 20, 1986

[54] INSECT BARRIER MEANS FOR SLIDING DOOR CONSTRUCTIONS

[75] Inventor: John H. Coller, La Puente, Calif.

[73] Assignee: D. G. Shelter Products Company, City of Industry, Calif.

[21] Appl. No.: 634,368

[22] Filed: Jul. 25, 1984

[51] Int. Cl.[4] ..... E06B 3/32

[52] U.S. Cl. ..... 160/91

[58] Field of Search ..... 160/90, 91, 89, 13; 49/406, 458; 52/207

[56] References Cited

U.S. PATENT DOCUMENTS

| | | | |
|---|---|---|---|
| 2,913,046 | 11/1959 | Sharp et al. | 160/91 |
| 2,931,434 | 4/1960 | Steel | 160/91 |
| 2,950,756 | 8/1960 | Moloney | 160/91 |
| 3,023,465 | 3/1962 | Sconzo | 160/90 X |
| 3,070,856 | 1/1963 | Minick | 160/91 X |
| 3,091,008 | 5/1963 | Riegelman | 160/90 X |
| 3,136,396 | 6/1964 | Sullivan | 160/91 X |
| 3,295,587 | 1/1967 | Horgan | 160/91 |
| 3,324,597 | 6/1967 | Rich | 160/90 X |
| 4,437,266 | 3/1984 | Keller | 49/406 |

*Primary Examiner*—Ramon S. Britts
*Assistant Examiner*—David M. Purol
*Attorney, Agent, or Firm*—Poms, Smith, Lande & Rose

[57] ABSTRACT

A sliding door construction in which two sliding door panels are adapted to be moved into open position or into a position where one panel is in open or partially open position and the other panel is in closed position and wherein one of the juxtaposed stile members of the door panels is provided with a movable pivoted insect barrier blade extending the length of the stile member and in operative insect barrier position lying normal to the plane of the door panels and having a width for virtually closing the space between the stile and the surface of the other door panel. In non-operative position of the barrier blade, the blade lies parallel to the plane of the door panels. The barrier blade has an actuator rib engageable by an actuator flange carried by the stile of the other door panel for pivotally moving the blade into the said normal position to the planes of the door panels and to parallel position of the door panels. A sliding door construction which additionally includes a fixed door panel and a fixed insect barrier blade carried by the stile of the sliding door panel proximate to the fixed panel. A barrier strip member for use between relatively movable sliding panels in which the strip member includes a flange section extending normal to the strip member and hinge means along a longitudinal edge of the blade member adjacent the flange section.

9 Claims, 12 Drawing Figures

Fig. 1.
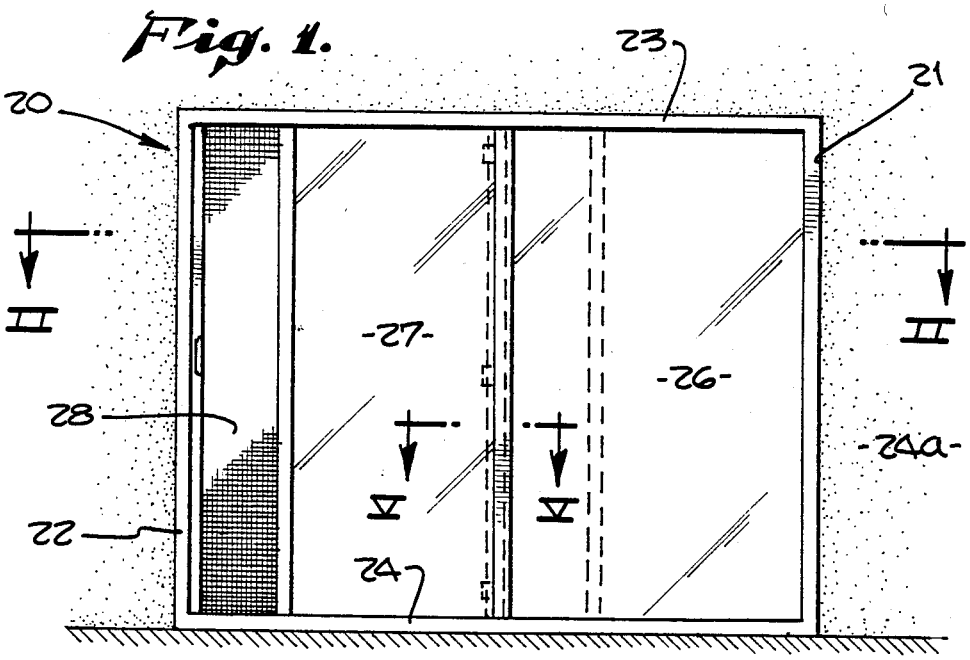
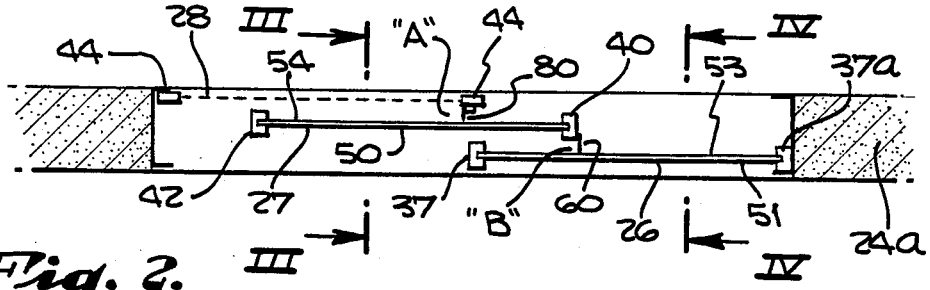
Fig. 2.
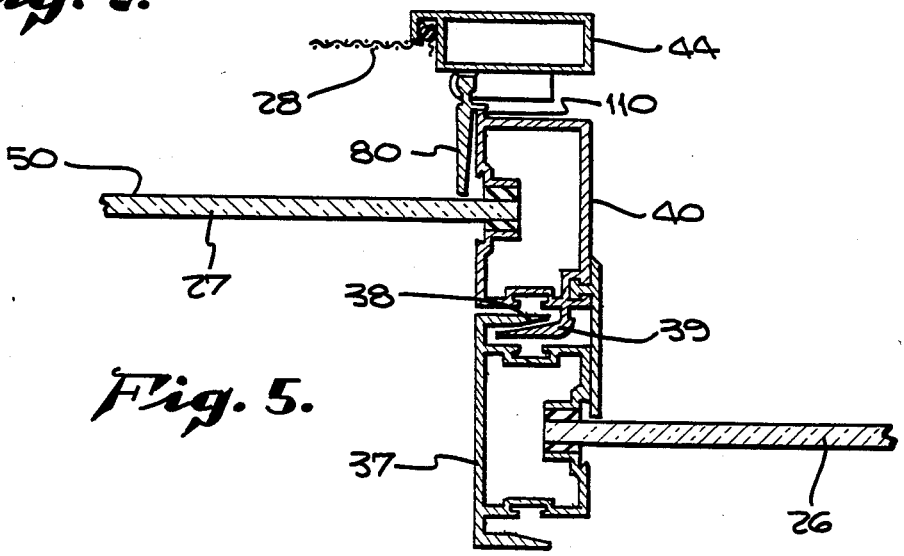
Fig. 5.

INSECT BARRIER MEANS FOR SLIDING DOOR CONSTRUCTIONS

SUMMARY OF THE INVENTION

The present invention relates generally to sliding door constructions and particularly to insect barrier means provided between two relatively moveable sliding door panels and between a fixed door panel and one of the sliding panels whereby an effective barrier to passage of flying insects between the door panels in closed and variably open positions is provided.

Generally, sliding door constructions may include different arrangements of sliding panels, for example, one arrangement may include an inside sliding glass panel, an outside fixed panel and an outside sliding screen. Another arrangement may include an outside sliding glass panel, an inside fixed panel and an inside sliding screen. A third arrangement of sliding panels includes an outside sliding panel, an inside fixed panel and an outside sliding screen. Each arrangement has some advantages and some disadvantages with respect to ability to withstand weather, maintaining appearance, ease of cleaning, and control of insects under different conditions of sliding door use. An outside sliding glass panel has been often preferred because of desirable weathering characteristics. An inside sliding screen door used with an outside sliding panel is afforded protection by the outside sliding panel and thereby may be easier to keep clean. However, control of passage of insects between an outside sliding panel and an inside sliding screen panel has been difficult and is often not satisfactory, due to the fact that the screen panel has to be opened, releasing insects to the interior prior to being able to close the sliding glass panel for security, weather or other reasons. An outside sliding glass panel with an outside screen panel presents a more pleasing interior appearance and is preferable in the eyes of many persons because of improved weather resistance, ease of cleaning, and the fact that no dirt or insects collect in the sill cavity as in the case of an inside sliding glass panel design.

The present invention provides an effective insect barrier control means for an arrangement which includes an outside sliding glass panel and an outside sliding screen. The insect barrier control means of this invention is effective between two adjacent sliding panels which are moveable relative to each other regardless of any degree of opening of the glass panel relative to the screen panel.

The present invention contemplates barrier control of the normally open vertical space between two relatively moveable sliding panels by providing a pivotally mounted barrier blade on a stile of the outside screen, the barrier blade having an edge remote from its pivot axis which lies in proximity to the plane of the outer surface of the outer sliding glass panel so that the space between the stile of the outside screen panel and the outer surfaces of the outside sliding glass panel is substantially closed to a space dimension which inhibits passage through said space of flying insects at any degree of opening of the glass panel relative to the door jamb. The invention contemplates an actuating means for such a pivotally mounted insect barrier blade which will permit relative movement of the sliding panels without damage or abrasion to the barrier blade. The invention also contemplates a sliding door construction in which two relatively moveable sliding panels are provided with the aforementioned pivotal insect barrier means and also a fixed barrier means provided on the outer sliding glass panel stile for cooperation with a fixed glass panel to effectively bar passage of flying insects through the space between the stile of the sliding glass panel and the surfaces of the fixed glass panel which would otherwise bypass the screen panel.

It is, therefore, a primary object of the present invention to provide an effective insect barrier means on sliding door constructions which include an inside fixed glass panel, an outer sliding glass panel, and an outside sliding screen panel.

An object of the invention is to provide an insect barrier blade member of integral construction, readily extrudable, and adapted to be readily pivoted between two angularly related positions, such as, at 90° to each other; the first position to provide insect control and the second position to allow safe bypass of the closed glass panel stile when the screen panel is opened.

Another object of the present invention is to provide an insect barrier means for sliding door constructions in which means are provided on the trailing stile of the sliding glass panel and on an insect barrier blade which provides automatic pivotal movement of the barrier blade upon relative sliding movement of the sliding glass panel and the insect screen panel.

A still further object of the present invention is to disclose an insect barrier means as mentioned above wherein means are provided on the trailing stile of the sliding screen panel and on the barrier blade for holding the barrier blade in each of its two positions under biased pressure engagement.

Still another object of the present invention is to provide an insect barrier blade so constructed as to be readily associated with hinge means carried by the stile of one of the sliding panels.

Various other objects and advantages of the present invention will be readily apparent from the following description of the drawings in which an exemplary embodiment of the invention is shown.

DESCRIPTION OF THE DRAWINGS

FIG. 1 is a schematic elevational view of a sliding door construction in partially open position and embodying this invention.

FIG. 2 is a schematic horizontal transverse section taken in the horizontal plane indicated by line II—II of FIG. 1.

FIG. 5 is a fragmentary enlarged sectional view taken in a horizontal transverse plane indicated at line V—V of FIG. 1 and illustrating the sliding door panel and sliding screen panel in door closed position instead of in partially opened position as shown in FIG. 1.

DETAILED DESCRIPTION

Figure 4:
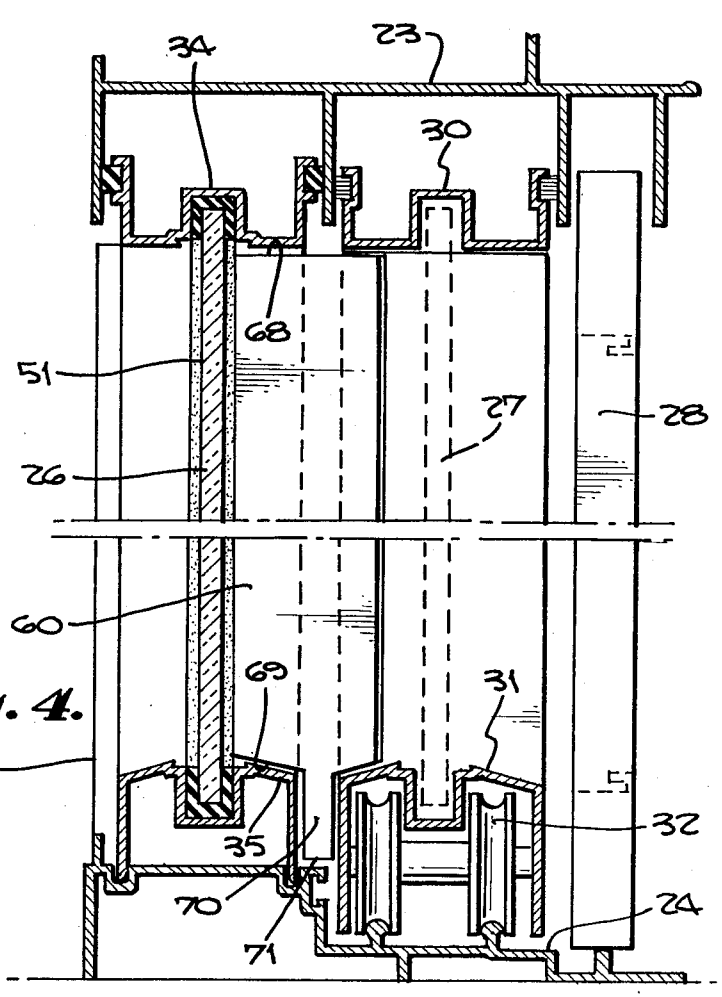
FIG. 4 is a sectional view taken in the vertical plane indicated by line IV—IV of FIG. 2.

In FIG. 1 a sliding door construction generally indicated at 20 embodying this invention is illustrated as installed in a wall 21 and generally comprises vertical door jambs 22 interconnected at the top by a header 23 and at the bottom by a sill 24. Within the frame made by jamb members 22, header 23 and sill 24 are provided an inside fixed door panel 26 located on the inside of wall 24, an outer sliding door panel 27, and an outside screen panel 28 provided on the outside of the door construction 20 and wall 24*a*. In FIG. 2 the outer sliding door panel 27 is shown in partially opened position and the outside screen panel in closed position.

Figure 3:
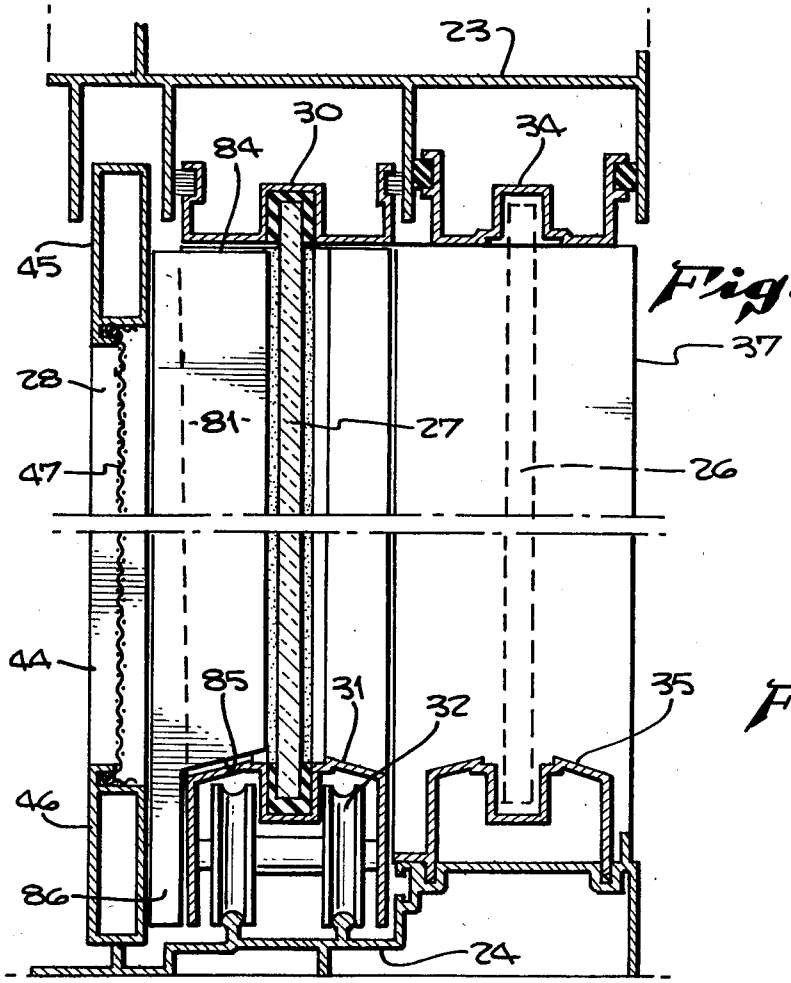
FIG. 3 is a sectional view taken in the vertical plane indicated by line III—III of FIG. 2.

In FIGS. 3 and 4 more detailed views are shown of the exemplary header 23 and sill 24. It will be understood that the detailed extrusions of the header 23 and 24 shown may be varied and do not form part of this invention. Similarly, the detailed extrusions of top rail member 30 and bottom rail member 31 of the outer sliding panel 27 which is provided with wheels or rollers 32 may be of different section. Similarly, the top rail 34 and the bottom rail 35 of fixed panel 26 may be made of different section. The exemplary vertical frame member or stile 37 for the fixed panel 26 may be provided with interlock portions 38 to cooperate with interlock portions 39 provided on the vertical frame member or stile 40 of the outer sliding door panel 27. Such interlock arrangement is not part of this invention. The vertical frame member or stile 42 of the sliding panel 27 (FIG. 2) may be cooperably received within vertical jamb member 22 in known manner. The fixed panel 26 is provided with a vertical frame member or stile 37*a* (FIG. 2) but similar to stile 42 for reception within the adjacent vertical jamb member 22.

Outside screen panel 28 may comprise vertical frame members or stiles 44 interconnected by top and bottom frame members or rails 45 and 46 and may be made suitable box section. The screen panel 28 includes a wire mesh screen 47 secured in usual manner.

The outer sliding panel 27 includes a sheet or pane of glass 50 secured in the top and bottom rails 30 and 31 and stiles 40 and 42 in well known manner. Fixed door panel 26 includes a sheet or pane of glass 51 likewise suitably secured in top and bottom rails 34 and 35 and in stile 37 and its opposed stile 37(*a*).

The present invention is particularly directed to providing a pivotal closure or barrier means for the vertically extending space formed by screen stile 44 and the outer glass surface 54 as indicated at "A" (FIG. 2). The space between the interlock stile 40 and the glass surface 53 of the pane 51 on the fixed door 26 is indicated at "B" and is closed by a fixed barrier means. Without the pivotal barrier means of this invention, when the outer sliding panel 27 is in partially opened position relative to the fixed panel and when the screen panel 28 is in closed position with the outer sliding panel 27 in partially open position, it will be readily apparent that the spaces "A" and "B" are sufficiently wide and large so that flying insects such as mosquitos, flies, and other bugs may readily pass from the outside of the outer sliding door to the inside thereof even though the screen panel 28 is in normally closed position.

Means for closing space "A" is best shown in FIGS. 5, 6, 7, 8 and 9. Means for closing space "A" comprises an elongated pivoted or hingedly mounted barrier blade 80 also made of suitable extrudable plastic material. Blade 80 includes an elongated blade portion 81 of selected width and having a tapered cross section 82 providing a longitudinal edge 83 in close proximate but not touching relation to the outer surface of the glass pane 50 of outer sliding panel 27. As best seen in FIG. 3 the top edge of blade 81 is closely adjacent to the downwardly directed surfaces of top rail 30 of outer sliding panel 27. The bottom edge of blade 81 may include an inclined portion 85 corresponding to the inclined surface of bottom rail 31 and a depending bottom edge portion 86 which extends between the side surface of bottom rail 31 and the bottom rail 46 of the outside screen panel 28.

Figure 6:
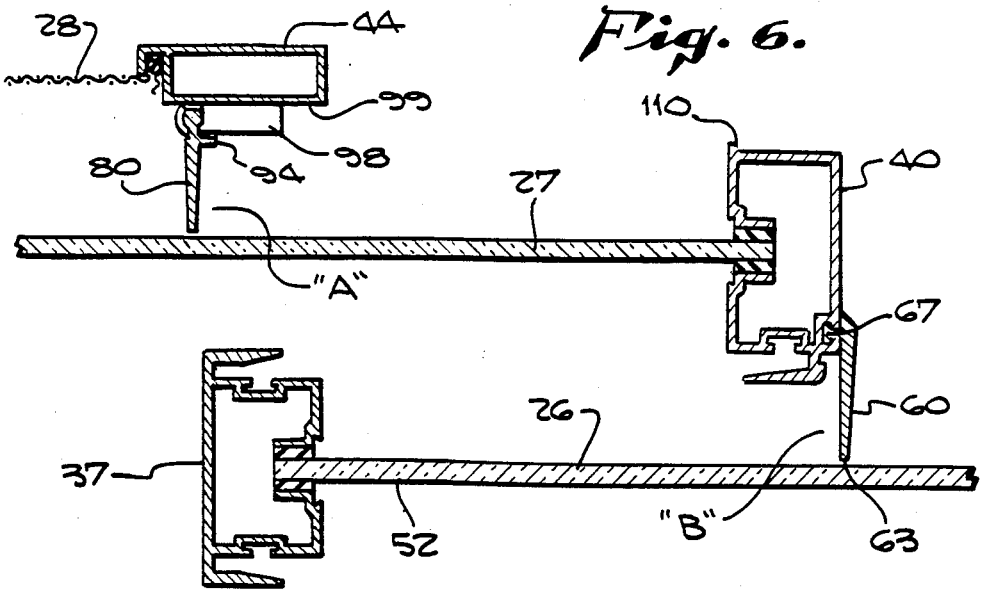
FIG. 6 is a fragmentary sectional view taken in a horizontal plane similar to the plane of line V—V and showing the screen and inside fixed panel in closed position and the sliding outer panel in partially opened position.
Figure 7:
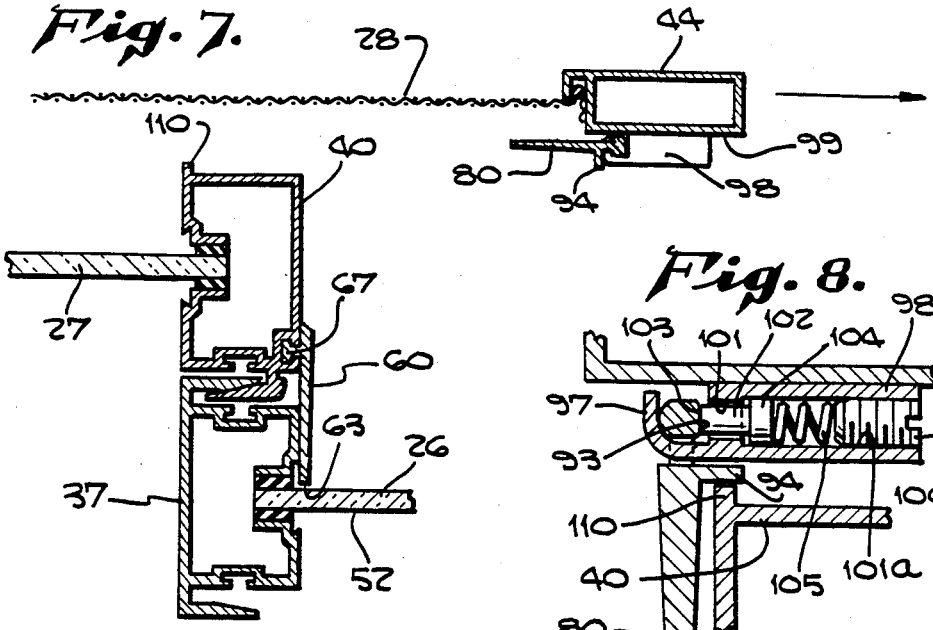
FIG. 7 is an enlarged fragmentary horizontal transverse sectional view showing the outer sliding panel in closed position and the screen panel in partially open position, as when entering from the outside.

Means for mounting blade 80 for movement between a barrier effective closed position as shown in FIGS. 5 and 6 to a barrier open position as shown in FIG. 7 may comprise a pivot means along the longitudinal edge portion 88 of blade 80. The pivot means comprises a longitudinally extending rib 89 of reduced material section as compared to the cross section at base 90 of the tapered section of the blade portion 81. Rib 89 is provided on its outermost edge and integral therewith an enlarged longitudinally extending bead portion 91 of a material section greater than the rib 89. Bead portion 91 is provided with contiguous longitudinally extending flat surfaces 92 and 93 in angular relation, such as 90°. Surfaces 92 and 93 assist in positioning blade 80 in 90° relationship to outer sliding panel 27 and in parallel relationship to screen panel 28 as later described.

Along one longitudinal face of blade 80 and extending in generally 90° relationship to the plane of blade 80 is provided an actuating member 94 which may comprise a longitudinally extending flange section or projection.

Means for hingedly connecting blade 80 to the vertical stile 44 of the screen panel includes the provision of two or more spaced openings 96 provided in rib 89 of blade 80. Openings 96 are adapted to receive a hook or partially curved shaped projection 97 provided along an edge of a hinge box 98 which may be secured in suitable manner to the inside facing surface 99 of the screen stile 44.

Figure 8:
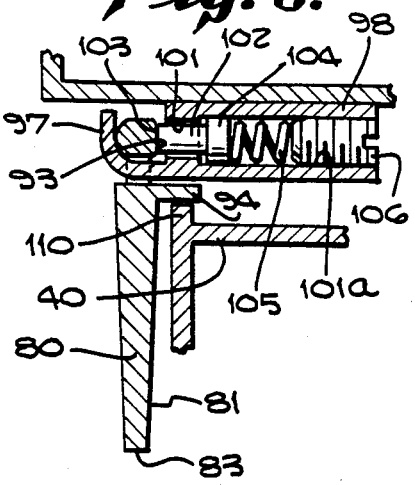
FIG. 8 is an enlarged fragmentary transverse sectional view taken through a hinge means in the position shown in FIG. 5.
Figure 9:
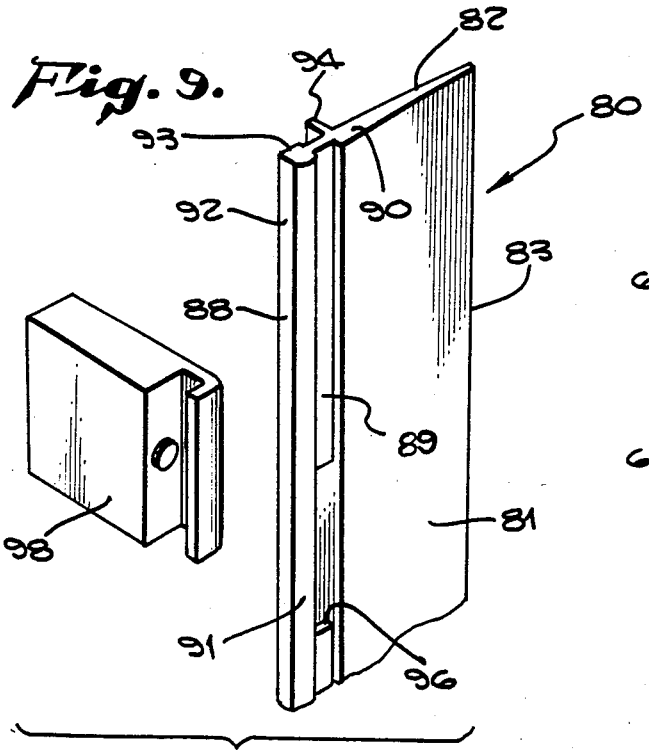
FIG. 9 is an enlarged fragmentary exploded view showing the hinge means and a portion of the insect barrier blade with an opening cooperable therewith.

Hinge box 98 may include a rectangular housing provided with a port 101 opposite the internal surface of the hook projection 97 and through which may extend a stem of a plunger 102 received in a bore 101*a* in the housing. The outer exposed end face 103 of the stem is adapted to pressure engage face 93 of bead 91 on the blade to position and hold blade 80 in normal closed barrier position as shown in FIGS. 5 and 6 and 8. The plunger 102 has an enlarged head 104 against which a pressure spring 105 may bear in order to spring bias plunger 102 into pressure engagement with the selected surface 93 or 92 of bead 91 of blade 80. Spring pressure may be adjusted by a set screw 106 provided in a threaded portion of bore 101*a*, the set screw being accessible from one side for adjusting the biasing pressure on plunger 102.

Figure 11:
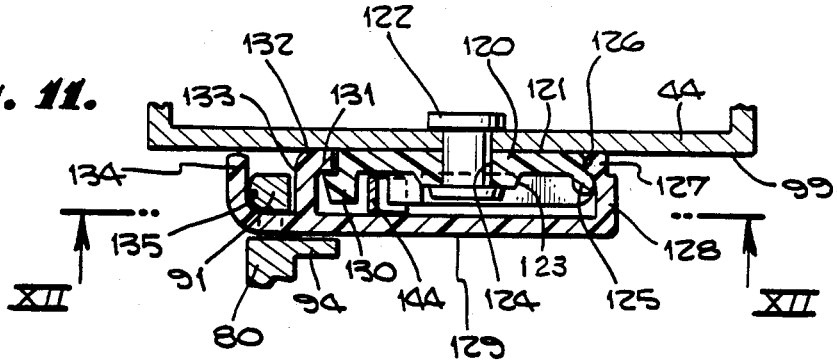
FIG. 11 is a sectional view taken in a plane indicated by line XI—XI of FIG. 12 showing a different embodiment of a hinge means.
Figure 12:
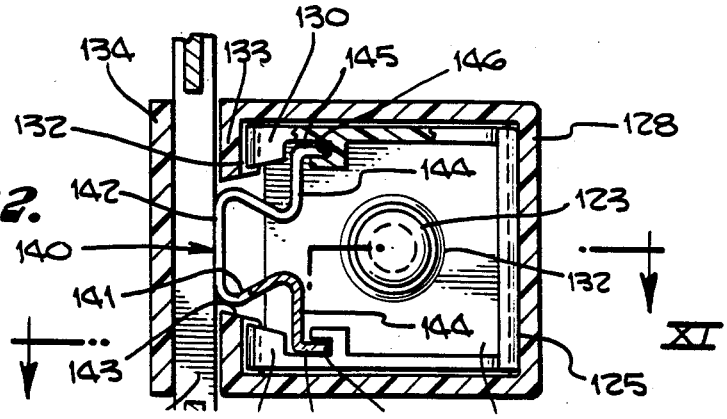
FIG. 12 is a sectional view taken in the plane indicated by line XII—XII of FIG. 11.

Another example of means for hingedly connecting blade 80 to a vertical stile 44 on the screen panel is shown in FIGS. 11 and 12. A rectangular base 120 may be provided with a flat surface 121 for bearing upon the surface of stile 44. The base 120 may be secured to this stile by means of a suitable rivet 122 seated on an internal boss 123 and extending through a bore 124. Base 120 includes an inwardly extending edge portion 125 providing an edge recess 126 for reception of a bead like bottom edge portion 127 provided on an end edge wall 128 of a cap or cover 129. Along the opposite edge, base 120 is provided with an upstanding wall 130 provided with an external undercut 131 adapted to engage an inturned edge lip 132 of edge wall 133 provided on cover 129. Cover 129 extends beyond edge wall 133 and is provided with a hook portion 134 defining a recess 135 into which bead 91 of pivotal blade 80 is captured.

The assembly of cover 129 with base 120 is readily accomplished by positioning edge 127 of the cover in edge recess 126 with the cover in upright position. The cover may then be pivoted downwardly until the inturned edge 132 is snapped into undercut 131. During this movement bead 91 is received within recess 135.

Within hinge means 120 a flat spring 140 is provided. Flat spring 140 includes a central loop 141 provided with a flat portion 142 at the top of the loop which extends through a central opening 143 in wall 133 of cover 129 adjacent hook portion 134. The tail portions 144 of the loop converge centrally and then are bent oppositely outwardly and terminate in bent end sections 145 which are received within recesses 146 provided internally of edge walls of base 120. Before assembly of the cover 129 with the base the flat spring 140 may be assembled on the base with the flat 142 extending partially outside of opening 143 and with the tail portions restrained by the recesses 146. Upon closure of cover 129 as described above, bead 91 is captured in the hook portion 134 and one of its flat surfaces is placed under biased pressure engagement by the flat 142 on the spring. It will be readily apparent that when the blade 80 is pivoted about the axis of the bead portion as described above the flat spring 140 will yield sufficiently to permit rotation of the blade and will exert spring pressure engagement against the contiguous flat surface on the bead portion. It will be further understood that other spring actuating means and other spring configurations may be used to provide the biasing pressure against the flat surfaces on the bead portion 91 of blade 80 to retain the blade in angularly related positions.

Figure 10:
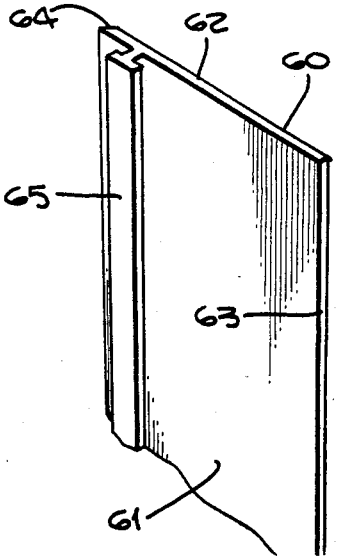
FIG. 10 is a fragmentary enlarged perspective view of a fixed insect barrier blade adapted to be carried by the outer sliding panel and to close the space between the inside fixed door panel and the interlock stile of the outer sliding panel.

With respect to closure of the space "B" between the fixed panel and the interlock stile 40 of the sliding panel 27 reference is particularly made to FIGS. 7 and 10. Means for closing space "B" comprises an elongated relatively rigid fixed barrier blade 60. Rigid blade 60 may be made of any suitable extrudable plastic material and may comprise an elongated blade portion 61 of uniform width and whose cross section indicated at 62 may be slightly tapered toward the longitudinal edge 63. Adjacent the opposite slightly thicker edge 64, blade 60 may be provided with a T-section mounting or securement portion 65 suitably dimensioned so that the blade may be received within a T-shaped recess 67 provided in interlock stile 40 of outer sliding panel 27. Blade 60 is thus rigidly mounted on stile 40, the width of the blade portion 62 being selected so that edge 63 will be closely proximate to but not touching the outside surface of the glass pane 51 of the fixed panel 26. As the outer sliding panel 27 is moved into open position, blade 60 moves therewith with its edge 63 adjacent to and along the outside surface of the glass 51 so as to effectively close space "B". As best seen in FIG. 4 the upper end of rigid blade 60 has an upper edge 68 which is adjacent to the downwardly facing surfaces of the top rails 34 and 30 of the fixed and sliding panels 26 and 27. The bottom edge 69 of blade 60 may correspond in shape to the inclined surfaces on the adjacent bottom rails 35 and 31 of the fixed and outer sliding panel. As best seen in FIG. 4, fixed blade 60 has a downwardly extending protrusion 70 which extends between said rails 35 and 31 and has a bottom edge 71 in close proximity to the sill 24. In any partially open position of sliding outer panel 27 the fixed barrier blade 60 closes space "B" and in closed position of the interlocks as shown in FIG. 7 rigid blade 60 acts as an additional barrier to any opening in the spaces at the interlocks.

Means for turning the blade 80 into normal or perpendicular position with respect to outer sliding panel 27 and in parallel position to the plane of the screen panel 28 may comprise an actuator rib or projection 110 integral with and extruded along the outside edge face of interlock stile 40 which is juxtaposed to stile 44 of screen panel 28. Rib 110 is cooperable with projection 94 on blade 80 as described hereafter.

Operation of the pivoted or hingedly movable barrier blade 80 under the several operating conditions of outer sliding glass panel 27 and outside sliding screen panel 28 will now be described. In closed position of each of door panels 27 and screen panel 28 as shown in FIG. 5, pivotally mounted blade 80 is positioned normal to the outer surface of the glass 50 of panel 27. When all panels of the door construction are in closed position it will be apparent from FIG. 5 that both spaces "A" and "B" are effectively closed by the proximity of the longitudinal edges of blades 80 and 60 to the respective outwardly facing surfaces of the glass panes 50 and 51. In such closed position actuator rib 110 on interlock stile 40 lies within the included angle formed by the actuator projection 94 on blade 80 and the adjacent face on blade portion 81.

In a door partially open condition as shown in FIG. 6 as when outer sliding panel 27 is moved to fully opened position and outside screen panel 28 remains in closed position, barrier blade 80 is in the same position as in FIG. 5 and blocks the passage of insects through the space "A". Further, the fixed barrier blade 60 which is attached to the interlock stile 40 of outer sliding panel 27 is in operative position to block passage of insects through the space "B".

When outside screen panel 28 is opened from the outside and before outer sliding panel is moved to open position, (the condition shown in FIG. 7), the blade 80 is pivoted about the axis of longitudinal bead 91 and against the biasing pressure of the plunger 102 to move blade 80 to a position parallel to outside screen panel 28 as shown in FIG. 7. To move the blade 80 to such parallel position as screen stile 44 is moved past the interlock stile 40 of the sliding panel the actuator rib 110 on stile 44 engages blade portion 81 adjacent the included angle formed by the blade portion and the actuator flange section 94 to push and to snap the blade 80 into such screen panel parallel position.

When the outside screen panel is slidably moved to closed position, the actuator flange section 94 will be brought into contact with the actuator rib 110 on interlock stile 40 and such contact will cause the blade portion 81 to pivot about the axis of bead portion 91 and to be moved into its normal barrier position 90° to screen stile 44. The forces used to close screen panel 28 under normal closure of a screen panel are sufficient to overcome the biasing effect of springs 105 and to permit rotation of the bead portion 91 from the engagement of one flat surface 92 by the pressure plunger 102 or other spring related means to the other flat surface 93.

From the above description and operation it will be readily apparent that the insect barrier blades 80 and 60 effectively close the spaces "A" and "B" in any relative position of the fixed panel and outer sliding panel when outside screen panel 28 is in closed position. It will also be understood that two or more hinge means 98 may be selectively spaced along the stiles of the screen panel or other types of panels in order to close a continuous space which occurs between the surface of the panel and a stile member of the panel. Other arrangements of hinge means and biasing means to assist in positioning movable blade 80 may also be used and other means for actuating the movable blade between operative and nonoperative positions may also be used.

Various modifications and changes may be made in the insect barrier means described above and which may fall within the spirit of this invention and all such changes and modifications coming within the scope of appended claims are embraced thereby.

I claim:

1. In a sliding door construction having an inside fixed door panel, a sliding outer door panel, interlock means between juxtaposed door stiles in closed position, an outside sliding screen panel opposite the outside sliding door panel, both outside panels being movable relative to each other and the fixed door panel, the interlock stile of the outer sliding panel forming a space between the interlock stile and the glass surface of the fixed panel when the outer sliding panel is fully or partially opened, and the screen panel having a screen stile forming a space with the glass surface of the outer sliding panel when the outer panel is fully or partially opened; the provision of:

barrier means for closing said spaces between the outer sliding panel, screen panel, and fixed panel; said barrier means comprising:

a fixed blade extending the length of said outer sliding panel interlock stile, carried thereby, and extending inwardly into close proximity with the glass surface of the fixed door panel;

a movable barrier blade carried by the screen stile and extending in operative position into proximity with the glass surface of the outer sliding panel and extending the length of the screen stile;

said movable blade in non-operative position being parallel to plane of the screen panel;

and means on the movable blade and means on the interlock stile of the outer sliding panel for actuating said movable blade into said two positions upon relative sliding movement of said sliding panels;

said means for actuating said movable blade includes:

hinge means for said movable blade carried by the screen stile;

an actuator member on said movable blade adjacent said hinge means and extending in closed position of the outer sliding panel in the direction of sliding of said sliding panel;

said means on said outer sliding panel interlock stile for actuating said movable blade including an outwardly extending projection adapted to engage said actuator member on the movable blade when the screen panel is opened to pivot said movable blade into a position parallel to the screen panel, and to return said movable blade to a position normal to the screen panel and into closed operative position.

2. In a sliding door construction including two sliding door panels having panel surfaces lying in spaced parallel planes adapted to be moved into open position or into a position where one panel is open or partially open and the other panel is closed, each of said door panels having frame members in juxtaposed position when both panels are in relatively displaced position, the provision of:

a movable closure blade extending the length of said frame members and in closed position of said sliding panels extending normal to the plane of said panel surfaces and having a width for virtually closing the space between said panels;

and means carried by one of said frame members for actuating said closure blade into and out of operative position;

said means for actuating said movable blade includes a projection on said blade;

a cooperative projection on said frame member of one of said sliding panels adapted to contact said projection on said blade to move said blade from inoperative position parallel to one of the panel surfaces to an operative position normal to said panel surfaces.

3. A sliding panel construction as stated in claim 2 wherein said blade includes:

pivot means extending along one edge thereof adjacent one of the sliding panels, means carried by said one of said panels for biased pressure engagement against said pivot means;

and means on said one edge for normally retaining said movable blade either normal to the plane of said panel surfaces or parallel to said panel surfaces when said sliding panel surfaces are in open condition.

4. A sliding panel construction as stated in claim 2 wherein:

said movable blade pivots about a longitudinal axis; and said projection on said blade normal thereto includes an elongated flange section spaced from said axis.

5. A sliding panel construction as stated in claim 2 wherein:

said cooperative projection on said frame member includes a longitudinally extending rib projecting from the outer surface of said frame member and adapted to be received within the included angle formed by said blade projection and blade.

6. A door construction as stated in claim 2 wherein said movable closure blade includes pivot means;

and hinge means carried by one of said frame members and engaged with said pivot means;

said hinge means including biased pressure means in engagement with said pivot means.

7. A sliding door construction as stated in claim 6 wherein said hinge means includes a spring for exerting pressure against said pivot means on said blade.

8. A door construction as stated in claim 7 wherein said spring means includes a flat configured spring member having a flat loop portion for contact with said pivot means.

9. A door construction as stated in claim 7 wherein said spring means includes a coil spring having one end exerting spring pressure forces in a direction toward said pivot means.

* * * * *